176-75 AU 113 EX
1/10/84 XR 4,425,191

United States Patent [19]
Evans

[11] 4,425,191
[45] Jan. 10, 1984

[54] ARRANGEMENT FOR MINIMIZING LEAKAGE FROM HEATED CHAMBERS AND METHOD FOR MAKING SAME

[75] Inventor: Joseph M. Evans, Murrysville, Pa.

[73] Assignee: Silicon Technology Incorporated, Greensburg, Pa.

[21] Appl. No.: 301,197

[22] Filed: Sep. 11, 1981

Related U.S. Application Data

[63] Continuation of Ser. No. 24,905, Mar. 29, 1979, abandoned.

[51] Int. Cl.³ ..... C09K 3/10; C10B 25/16; E06B 7/16; F27D 1/18

[52] U.S. Cl. ..... 201/41; 34/242; 49/485; 106/33; 106/75; 110/173 R; 202/242; 202/248; 202/269; 266/271; 432/250

[58] Field of Search ..... 202/242, 248, 269, 243–247, 202/249–253; 52/232; 49/475, 506, 484, 485, 488; 106/33, 75, 74; 264/30; 266/264, 271, 273; 201/41; 110/173 R; 432/242, 250, 251; 277/DIG. 6, DIG. 10, 26; 428/920, 921; 122/498; 126/190; 34/242; 220/226, 363; 252/606; 423/332

[56] References Cited

U.S. PATENT DOCUMENTS

| | | | |
|---|---|---|---|
| 2,956,914 | 10/1960 | Bunezk | 432/250 |
| 4,024,310 | 5/1977 | Wooler et al. | 428/921 |
| 4,061,344 | 12/1977 | Bradley et al. | 277/26 |
| 4,296,540 | 10/1981 | Potter | 34/242 |

OTHER PUBLICATIONS

Vandersall; "Intumescent Coating Systems . . . "; J. Fire & Flammability; vol. 2; pp. 97, 137 & 138; Apr. 1971.

*Primary Examiner*—Bradley Garris
*Attorney, Agent, or Firm*—Fleit, Jacobson, Cohn & Price

[57] ABSTRACT

A heated chamber having at least one opening; closure means for closing said at least one opening, said closure means having at least a closed and open position; said closure means and said opening having surfaces disposed for coming into proximity of one another in said closed position, said surfaces forming a primary sealing means for said heated chamber in said closed position, there being a substance applied to at least one of said proximate surfaces, said substance having a property of expanding upon the application of heat thereby forming a secondary sealing means between said proximate surfaces in said closed position.

9 Claims, 6 Drawing Figures

ARRANGEMENT FOR MINIMIZING LEAKAGE FROM HEATED CHAMBERS AND METHOD FOR MAKING SAME

This is a continuation of application Ser. No. 24,905, filed Mar. 29, 1979 now abandoned.

BACKGROUND OF THE INVENTION

1. Field of the Invention

This invention relates generally to sealing arrangements and method of making same, and more particularly, sealing arrangements for heated chambers and methods for sealing same.

It is well known especially from Environmental Reports and the news media that the sealing of ovens which produce noxious fumes, smoke, dust, etc., is a difficult art. Only recently the coke industry in the major steel producing area of the United States has been threatened with a complete shutdown because of its inability to comply with the new Environmental Regulations of the Environmental Protection Agency of the U.S. of America and the Department of Environmental Resources of the Commonwealth of Pennsylvania.

An example of a coke oven which presently has sealing problems, is a coke oven with a so-called Koppers Door. The coke oven with the Koppers Door utilizes an S-shaped seal for sealing the door against the jamb of the oven. Because of irregularities in the jamb and seal, gases from within the coke oven readily leak past the jamb. In cases where the seal surfaces have been damaged by loading and unloading of coal and coke, gouges occur therein, which greatly increase the flow of noxious gases and fumes from the coke oven to the surrounding air. This leakage from damaged ovens is especially undesirable since the degree of pollution caused thereby is many fold that of an oven in preferred condition. However, during long use coke ovens are damaged by the constant loading and unloading and seal cleaning, therefore, a larger and larger percentage of the ovens leak at ever increasing rates.

Another door widely used in the coke industry is the Wilputte Door. The Wilputte Door has a diaphragm seal and a jamb with an adjustable screw for making contact more readily between the jamb and the door. The Wilputte Door also suffers from the same sort of problems that the Koppers Door does. A great need is also felt for an imporved sealing arrangement therein.

Recent tests have shown that many of these doors in present operation in their present configurations do not permit operation within the guidelines set by the Department of Environmental Resources and the Environmental Protection Agency. The fact of the lack of capability of meeting these requirements is well known and has threatened to shut down the steel industry for lack of coke. Therefore, a great need is felt for an improved door sealing arrangement which would permit operation within the guidelines of the Environmental Protection Agency or the Department of Environmental Resources.

There are a great number of other applications where leakage from ovens and other heated chambers can be cured by use of my invention such as soaking pits, used for the soaking of iron ingots during the manufacture of iron and steel, furnaces and other examples which are too numerous to mention herein.

2. Description of the Prior Art and Results of Novelty Search

A means of attempting to seal a coke oven is disclosed in U.S. Pat. No. 3,875,018 to Calderon in which a collodial mixture is injected into a passage from which it leaks out in such a way that during the coking cycle the mixture becomes gummy and sticky for sealing crevices between the door and the jamb. The mixture dehydrates and develops non-wetting and non-adhering properties by hardening into a strong solid mass. This method requires a special door design which incorporated channels for receiving the mixture. Problems have been discovered in the injection of the mixture into the channel because the mixture has a tendency to leak out of the channel and past the seal before it has an opportunity to harden sufficiently.

The novelty search conducted prior to the preparation of this application turned up U.S. Pat. No. 2,279,791, which only teaches the application of the material which expands when subjected to elevated temperatures. This material is used to coat the individual wires of a fire screen. The fire screen thus coated, when exposed to elevated temperatures causes the material to expand. The expansion closes the openings between the individual wires of the screen, thereby restricting the flow of air at elevated temperatures through the fire screen.

Another result of the novelty search is U.S. Pat. No. 3,814,613 which discloses the use of a refractory composition for patching the walls of a coke oven. This refractory composition comprises siliceous aggregate, plastic clay, a chemical binder such as sodium silicate, chromic acid, boric acid, sodium sulfate, magnesium sulfate, sodium phosphate and organic binders and finally, a source of manganese dioxide. The patching material may be applied by the troweling or plastering over a cracked area in the wall of the coke oven or by pumping or injecting the material into cracks in the wall or by pneumatically gunning. This patent has the object of providing a patching material for coke ovens which has a long lasting bond with used silica brick.

SUMMARY OF THE INVENTION

The present invention relates to the sealing of heated chambers, preferably coke ovens, from which gases, fumes and other noxious materials may escape. These chambers have at least one opening therein for receiving contents to be processed therein in some manner. This opening has preferrably some sort of closing element for the gross sealing thereof from the surrounding atmosphere. This element may be a door. This door has primary sealing surface for making at least a rudimentary seal between the door and the jamb which reduces the leakage of gases, fumes and other noxious materials from the chamber to the surrounding environment. In addition to the primary seal, a secondary seal is provided which is placed or disposed in such a way as to enhance the sealing function of the primary seal. In addition, this secondary seal is made from a material which changes dimensions such as to foam and expand when exposed to heat and preferrably expands to complement or surround the primary seal, thereby, greatly improving the ability of the primary seal to contain the gases, fumes and other noxious materials.

This secondary sealing means is preferrably applied in a liquid state and is comprised of a material such as liquid sodium silicate which provides a sealing capability which improves as the temperature rises because of its property to foam and expand when heated. Other intumescent materials, that is materials with which expand upon the application of heat, are within the scope of this invention.

The sealing mixture or medium is formed by mixing preferrably an intumescent material such as sodium silicate to a desired viscosity which when applied at temperatures before the chamber is heated will permit an accumulation thick enough to surround the primary seal when making a seal against the jamb, upon the closing of the oven door.

DETAILED DESCRIPTION OF THE DRAWINGS

Figure 1:
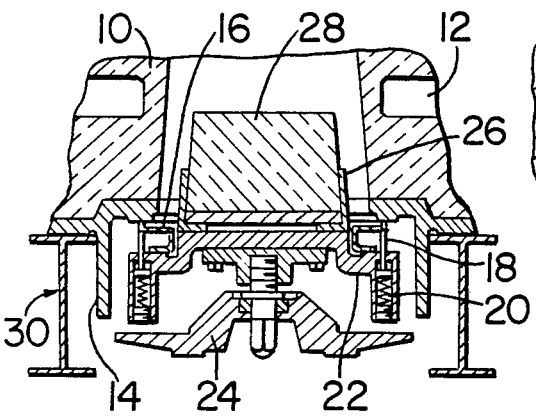
FIG. 1 is a cross-sectional view of a Koppers oven door having an S shaped seal and a jamb according to the prior art.

Referring now to FIG. 1, oven walls 10 are shown with flues 12 therein. Abutting the walls are jambs 14. Making contact with the jambs 14 are S shaped seals.

Plungers 18 have springs 20 for urging the S shaped seals 16 against the jambs 14. The opposite ends of the S shaped seals 16, not making contact with the jambs 14, abut a door frame 22 which has a latch 24 for opening, closing, and locking the door. Also attached to the door frame 22 are retainers 26 which hold a plug 28 there between. A brickstay 30 abuts the jambs 14 on the sides opposite the oven walls 10.

Figure 2:
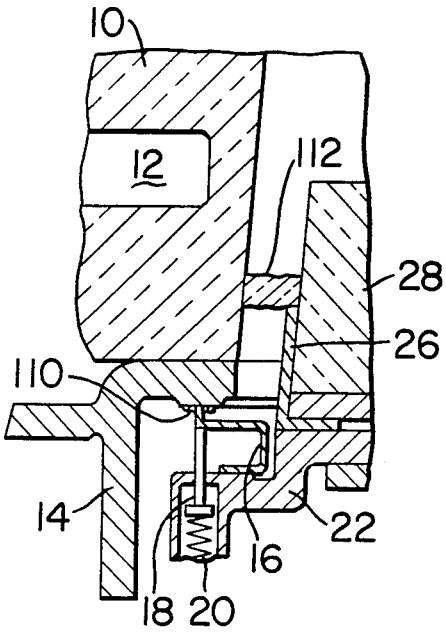
FIG. 2 illustrates the invention applied to the Koppers oven door of FIG. 1.

Referring now to FIG. 2, a partial cross section of the Koppers door of FIG. 1, is shown having one of the S shaped seals 16, one of the door jambs 14 and the plug 28. In the area of the jamb 14 onto which the S shaped seal 16 abuts an intumescent material 110 is applied. The intumescent material foams and expands upon exposure to the elevated temperature during the making of coke. This expansion provides a gas-tight seal between the jamb 14 and the S shaped seal 16.

As an alternative embodiment also shown in FIG. 2 between the plug 28 and the oven wall 10 a mass of intumescent material 112 is applied. This mass of intumescent material 112 has the same function as the intumescent 110, and will foam and expand upon exposure to elevated temperatures.

If there are any gouges or cracks or other irregularities in the jamb 14 or as in the alternative embodiment as shown in this same FIG. 2 in the oven wall 10, the intumescent material either 110 or 112, as the case may be, will fill these gouges, cracks, or other irregularities both upon application and subsequent thereto, during expansion in the heating process and form an extremely efficient seal even under these adverse conditions where the primary seal, the S shaped seal 16, is not operative satisfactorily.

Figure 3:
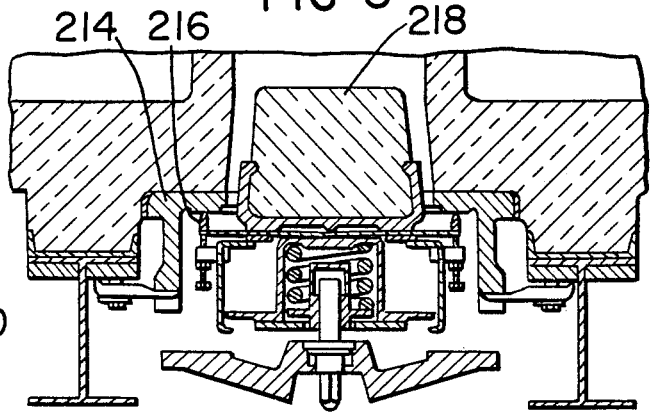
FIG. 3 is a cross-sectional view of a Wilputte door according to the prior art.

FIG. 3 is similar to FIG. 1, in that it shows a prior art Wilputte door instead of a Koppers door. Moreover, it has a similar jamb 214 with a diaphragm seal 216 which makes contact with the jamb 214. The Wilputte door has a plug 218 similar to the Koppers door of FIG. 1.

Figure 4:
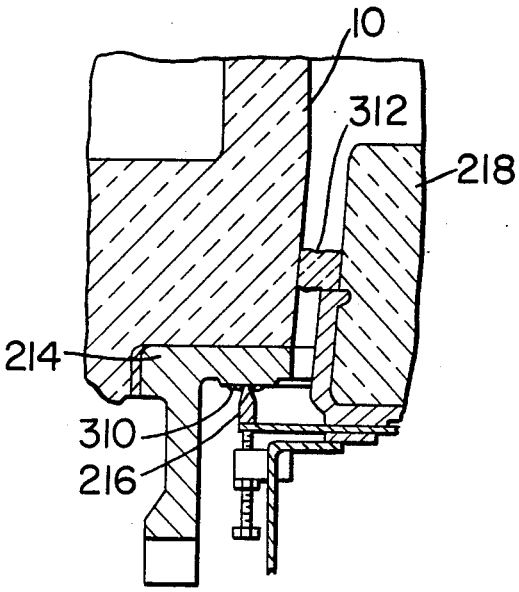
FIG. 4 illustrates the invention applied to the Wilputte door of FIG. 3.
Figure 5:
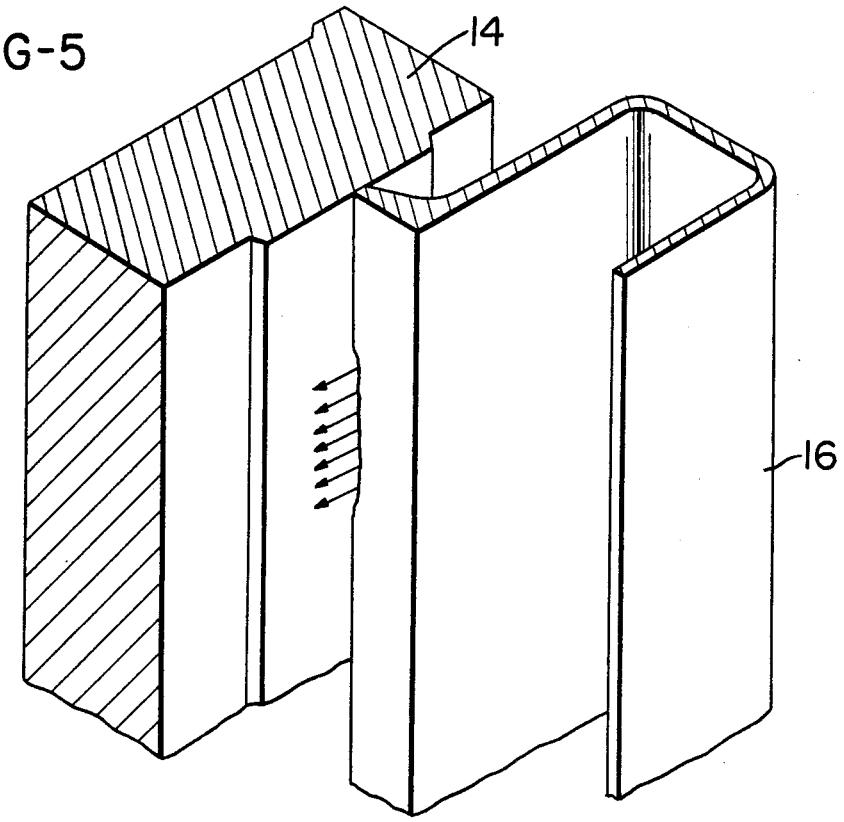
FIG. 5 is a three dimensional view of a segment of an S shaped seal showing gas leakage gaps as in the prior art.
Figure 6:
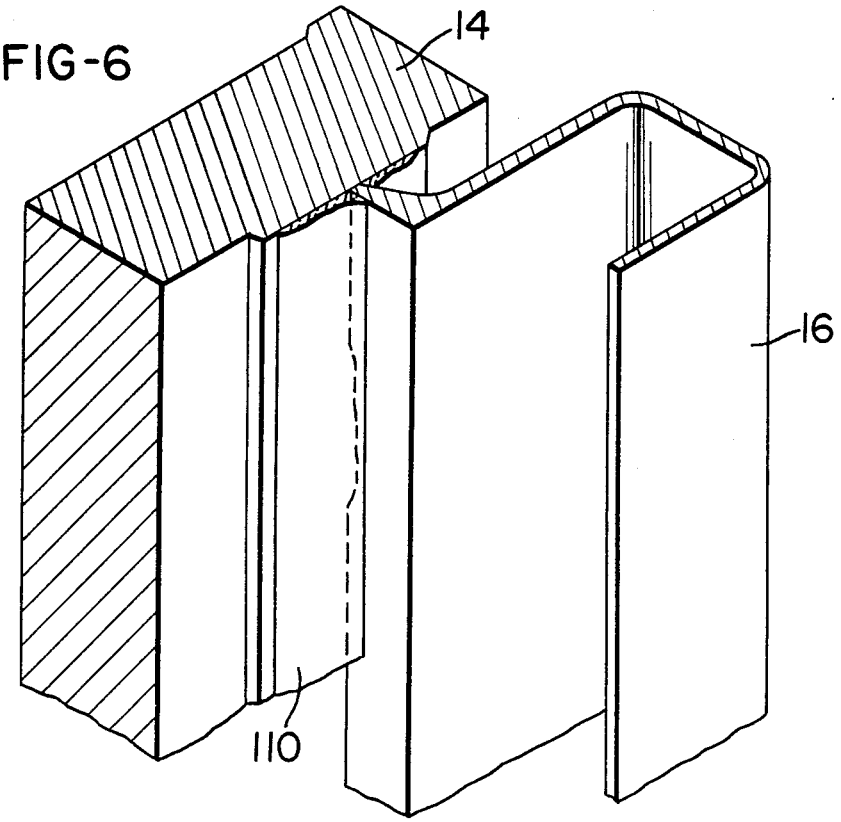
FIG. 6 illustrates the present invention applied in FIG. 5.

FIG. 4 shows the placement of an intumescent material 310 with the diaphragm seal 216 and the jamb 214 as shown in FIG. 3.

Also in FIG. 4 an alternative embodiment of the Wilputte door according to the present invention is shown, that is, between the oven wall 10 and the plug 218 another body of intumescent material 312 is placed for the sealing of the opening there between.

The intumescent material may be a polverulent cellulatable glass such as ground glass with a high carbon content mixed with silicate and a clay. The clay is believed to be preferrably ball clay or china clay which are used because of their fine texture.

Another formulation of intumescent material which has been shown to be satisfactory is liquid sodium silicate having a viscosity of 400 centipoise when blended. The liquid sodium silicate is preferrably applied directly to the horizontal seal surfaces with a pressurized spray gun which produces a fine atomized discharge such as a portable pressurized sprayer. The material sprayed on the horizontal surfaces may also be sprayed with a pressurized spray gun which produces a finely atomized discharge and permitted to coat these surfaces to a thickness of about ten-thousandths of an inch in one pass or, yet more preferrably, in two passes to a thickness of twenty-thousandths of an inch. It has been shown that there is little or no running of the material when applied in this manner. The sodium silicate adheres to the oven and will produce a seal upon the application of heat to the intumescent material which has the property in its present form of enlarging or expanding upon being heated thereby making a good seal. On vertical surfaces the liquid sodium silicate is preferably blended to a viscosity of approximately 950 centipoise or combined with granular sodium silicate to achieve higher viscosities and thixa tropic behavior and applied to a heated surface at or above 100° C. In certain applications other materials may be added to the liquid sodium silicate such that it will more readily adhere to vertical surfaces and inhibit the tendency to run thereon.

The applicant has found that a viscosity of between 400 to 950 centipoise is adequate for the applications that he has investigated. However, even lower viscosities may be adequate and can be determined by experimentation. The applicant also believes that mixtures have viscosities which decrease as the shear rate increases will reduce the tendency of the sealer to run off the surface after it has been applied thereto. Other methods of applying the liquid sodium silicate or other materials having intumescent materials may be by the formation of a gasket, the application of the mixture with a brush or trowel or any other applicable method, even aerosol sprays may be useful under certain sets of circumstances and conditions. The applicant has additionally found that the mixture may be applied to the goose neck portion of a coke oven to effectively seal it as well as a door.

What is claimed is:

1. A heated chamber having at least one opening, closure means for closing said at least one opening, said closure means at least a closed and open position, said closure means and said opening having surfaces disposed for coming into proximity of one another in said closed position, said surfaces forming a primary sealing means for said heated chamber in said closed position, there being a substance applied to at least one of said proximate surfaces, said substance being an intumescent substance which foams and expands upon the application of heat, thereby forming a secondary sealing means between said proximate surfaces in said closed position, when said substance is in a foamed and expanded condition, said substance consisting essentially of a liquid silicate.

2. A heated chamber according to claim 1, wherein said substance, when applied, has a viscosity between 400 and 950 centipoise.

3. A heated chamber according to claim 1, wherein said heated chamber is a coke oven.

4. A method of sealing a heated chamber having at least one opening with closure means therefor, said closure means forming a primary sealing means for said chamber, comprising the steps of: applying an intumescent substance which foams and expands upon heating, to at least one surface between said at least one opening and said closure means, said substance on foaming and expanding, forming a secondary sealing means for said chamber, said substance consisting essentially of a liquid silicate.

5. A method as claimed in claim 4, wherein said substance is applied to said surface with the temperature of said surface being at or above 100° C.

6. A method as claimed in claim 4, wherein said applying is accomplished by spraying or trowelling the substance onto said at least one surface.

7. A method as claimed in claim 4, wherein said substance is applied at a viscosity between 400 and 950 centipoise.

8. A method as claimed in claim 7, wherein said substance is applied as a layer between 10 and 20 thousandths of an inch in thickness.

9. A method as claimed in claim 4, wherein said heated chamber is a coke oven.

* * * * *

UNITED STATES PATENT AND TRADEMARK OFFICE

CERTIFICATE OF CORRECTION

PATENT NO. : 4,425,191

DATED : January 10, 1984

INVENTOR(S) : JOSEPH M. EVANS

It is certified that error appears in the above-identified patent and that said Letters Patent is hereby corrected as shown below:

The following additional prior art was made of record:

[56] References Cited

U.S. PATENT DOCUMENTS

| | | | |
|---|---|---|---|
| 2,040,887 | 5/1936 | Van Ackeren | 202/248 |
| 2,279,791 | 4/1942 | Lamb | 169/2 |
| 3,814,613 | 6/1974 | Hubble et al | 106/68 |
| 3,864,883 | 2/1975 | McMarlin | 52/232XR |
| 3,875,018 | 4/1975 | Calderon | 202/248 |
| 4,111,709 | 9/1978 | Price et al | 202/269XR |
| 4,164,108 | 8/1979 | Ortmanns | 52/232 |
| 4,187,335 | 2/1980 | LaBate | 427/318 |
| 4,189,457 | 2/1980 | Clement, Jr. | 201/41XR |
| 4,230,498 | 10/1980 | Rueckl | 264/30XR |
| 4,251,322 | 2/1981 | LaBate | 201/2 |

UNITED STATES PATENT AND TRADEMARK OFFICE

CERTIFICATE OF CORRECTION

PATENT NO. : 4,425,191

DATED : January 10, 1984

INVENTOR(S) : JOSEPH M. EVANS

It is certified that error appears in the above-identified patent and that said Letters Patent is hereby corrected as shown below:

OTHER PUBLICATIONS

Hoffman et al, "Development and Demonstration of Concepts for Improving Coke-Oven Door Seals: Interim Report", Battelle Columbus Laboratories, Columbus, Ohio, Aug. 1978 (Contract No. 88-02-2173)

Lownie, Jr. et al, "Study of Concepts for Minimizing Emissions from Coke-Oven Door Seals", Battelle Columbus Laboratories, Columbus, Ohio, July 1975 (Contract No. 68-02-1439)

Signed and Sealed this

*Eighteenth* Day of *December 1984*

[SEAL]

*Attest:*

GERALD J. MOSSINGHOFF

*Attesting Officer*

*Commissioner of Patents and Trademarks*